United States Patent [19]

Horn

[11] 4,130,297

[45] Dec. 19, 1978

[54] RELEASE SKI BINDING

[75] Inventor: Hans Horn, Wellington, New Zealand

[73] Assignee: TMC Corporation, Baar, Zug, Switzerland

[21] Appl. No.: 791,408

[22] Filed: Apr. 27, 1977

[30] Foreign Application Priority Data

Apr. 30, 1976 [AT] Austria ..... 3216/76

[51] Int. Cl.[2] ..... A63C 9/086

[52] U.S. Cl. ..... 280/618; 280/613

[58] Field of Search ..... 280/613, 618, 617, 616, 280/626, 611, 605, 629, 630

[56] References Cited

U.S. PATENT DOCUMENTS

| | | | |
|---|---|---|---|
| 3,924,869 | 12/1975 | Strub | 280/613 |
| 3,936,064 | 2/1976 | D'Alessio | 280/629 X |
| 3,958,811 | 5/1976 | Sittmann | 280/618 |
| 3,964,760 | 6/1976 | Riedel | 280/605 |
| 4,027,896 | 6/1977 | Frechin | 280/618 |

*Primary Examiner*—Joseph F. Peters, Jr.
*Assistant Examiner*—Gene A. Church
*Attorney, Agent, or Firm*—Blanchard, Flynn, Thiel, Boutell & Tanis

[57] ABSTRACT

A release ski binding utilizing a release plate on which is secured a release plate boot, the combination of the ski boot and the ski being releasably secured to the ski by front and rear locking members. The front locking member has a metal fitting which is secured to the ski and is received in a recess on the underside of the release plate. The rear locking member is formed by two swivel members which are supported in a recess in the release plate and are supported for pivotal or swingable movement against the force of a spring and engage a rear metal fitting which is also secured to the ski.

24 Claims, 13 Drawing Figures

RELEASE SKI BINDING

FIELD OF THE INVENTION

The invention relates to a release ski binding having a release plate which can be clamped releasably on the ski by means of locking members, which release plate is pivotally supported about a pivot pin which is secured on the ski and is supported liftably from said pivot pin, wherein the ski boot is held on the plate by means of a front and a rear holding mechanism.

BACKGROUND OF THE INVENTION

A release ski binding of the abovementioned type is described for example in Swiss Pat. No. 558,187. Details of this known release ski binding relate to an improved stepping in so that during buckling in, a manipulation on the bar is not needed. However, the known construction requires, for holding down the release plate on the ski, two resilient locking mechanisms. Thus separate mechanisms must be provided for the release operations in the rear and front area of the release plate, which mechanisms cooperate with the individual locking mechanisms. The use of two release mechanisms is expensive. Moreover the locking mechanisms are designed as pistonlike members which extend over the surface of the release plate so that deposits of snow, ice or the like cannot be ignored because such deposits not only in an unfavorable manner increase resistance during skiing, but, possibly, can also effect the release operations.

The object of the invention is to overcome these disadvantages and to provide in a release ski binding of the abovementioned type a simple, as much as possible closed locking possibility for the release plate.

The set purpose is attained according to the invention by the front locking member having a metal fitting which is secured on the ski, which metal fitting engages a recess on the underside of the release plate, and by the rear locking member being formed by two swivel members which are supported in a recess of the release plate, are supported swingably against spring force and can engage a rear metal fitting which is secured on the ski.

Due to the inventive design of the release ski binding, one locking mechanism which is provided in the rear area is sufficient to meet the requirements which are placed on a release ski binding which is equipped with a release plate. The inventive release ski binding is compact, is totally protected against interference by snow, ice or the like at least at the most sensitive parts.

According to a preferable embodiment of the invention, the swivel member can be supported on a piston, which piston is guided in a recess in the sole plate, wherein the initial tension of the springs can be varied by means of a spring plate and a setscrew, as is actually known. This embodiment assures that the release is accomplished in each case by overcoming one spring force, however, during a fall forwardly both springs become active. During a diagonal fall values are created which lie between the force of one and the force of both springs. Thus the spring force which is to be overcome is adjusted to the stresses.

According to a further development of the invention, the swivel members each have a protuberance which is gripped under by a holding part which is fixedly connected to the release plate, through which an absorption of the acting forces takes place and a sliding of the swivel members from the release plate in the released condition of the same is prevented.

According to a further characteristic of the invention, the swivel members can each have an extension, through which each swivel member can each engage one ear of the rear metal fitting. This characteristic permits a very simple design of the rear holding part, whereby an exactly regulated release operation is made possible.

The lateral release operation is done in such a manner that in the initial phase of the release, the active swivel member pivots about the vertical edge of the metal fitting until it no longer engages it, and that the rear metal fitting has a shoulder on each side along which during the later release operation at least one of the swivel members is slidingly guided. Due to the construction of the inventive release ski binding, only one swivel member slides during a lateral release operation on the shoulder of the metal fitting. If therefore a release rotating to the right is to take place, the swivel member which in travelling direction is on the right side will slide on the shoulder of the rear metal fitting and if the lateral release takes place rotating to the left, then the swivel member which in travelling direction is on the left side slides on the shoulder of the metal fitting.

According to a further inventive thought, the release plate has a reinforcing insert and, as is actually known, receiving bores are provided on both sides for the legs of a linkage. The linkage is part of a tensioning means which forms the rear holding mechanism for the ski boot, wherein the insert extends to the area of the receiving bores. This measure is particularly of advantage if the release plate is made of plastic. However, also in the case of a release plate of light metal a reinforcing insert for receiving the bores for the legs of the linkage of the tensioning means can be purposeful for increasing the lifetime of the release ski binding.

A further development of this measure consists inventively in the tensioning means having outwardly directed wings, which are supported after overcoming the dead-center position on the linkage.

A further inventive thought consists in the pivot pin having a housing held on the ski by a holding plate, which housing has a recess extending in longitudinal direction of the ski for receiving a spring and a slide supported in the housing which can be moved in longitudinal direction of the ski and against the force of the spring. Through this design of the pivot pin, both the necessary lateral mounting or guide of the release plate on the ski is assured and also stepping in is carried out easily and securely.

In a further development of this inventive thought, the periphery of the housing or of the slide of the pivot pin can be designed semicircularly in top view. Since the pivot pin, as is known, cooperates with a circular recess of the release plate, the just now described construction assures a perfect rotary movement of the release plate about the pivot pin, wherein the slide and the housing can be moved in one another.

According to a still further characteristic of the invention, a wire bar is pivotally supported for movement about an axis extending transversely to the longitudinal direction of the ski in the holding plate, which wire bar, in vertical upright position and during stepping in, cooperates with a receiving recess in the bottom of the release plate and thus forms a step-in aid during a stepping down of the sole plate for same. This construction is of advantage because due to the tranversely extending leg of the wire bar, a substantially greater control surface for the release plate cooperates with the part provided on the ski than if introduction of the release plate would be accomplished exclusively by means of the housing.

In a further development of this inventive thought, the free ends of the wire bar can project over the side of the ski and can be bent as a wing of a ski brake. The construction of such a ski brake is actually known, however, is new in cooperation with an abovementioned release ski binding. The advantages of such a combination are obvious.

BRIEF DESCRIPTION OF THE DRAWINGS

The invention will be described more in detail in connection with the drawings, which illustrate one exemplary embodiment.

In the drawings

DETAILED DESCRIPTION

Figure 1:
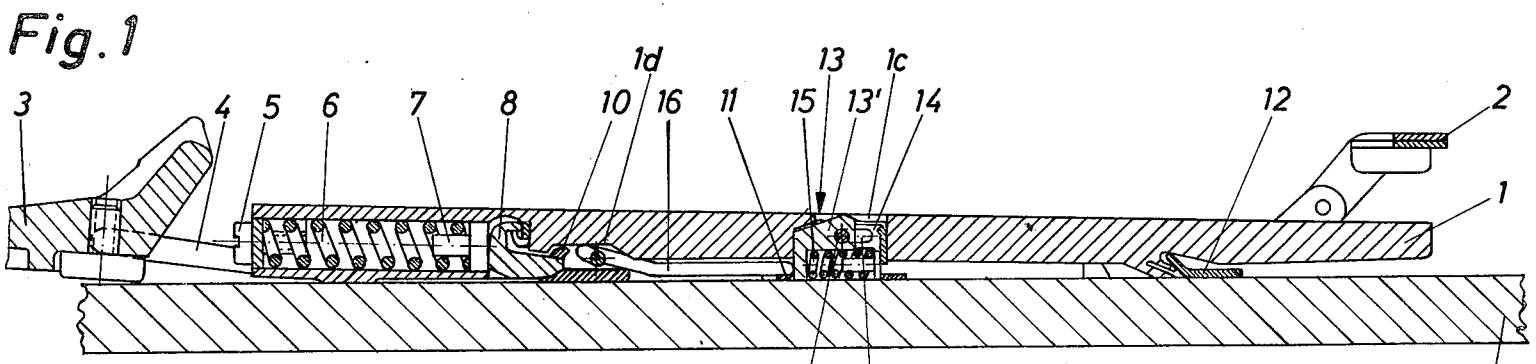
FIG. 1 is a longitudinal sectional view of a ski binding embodying the invention taken along the line I—I of FIG. 2.
Figure 2:
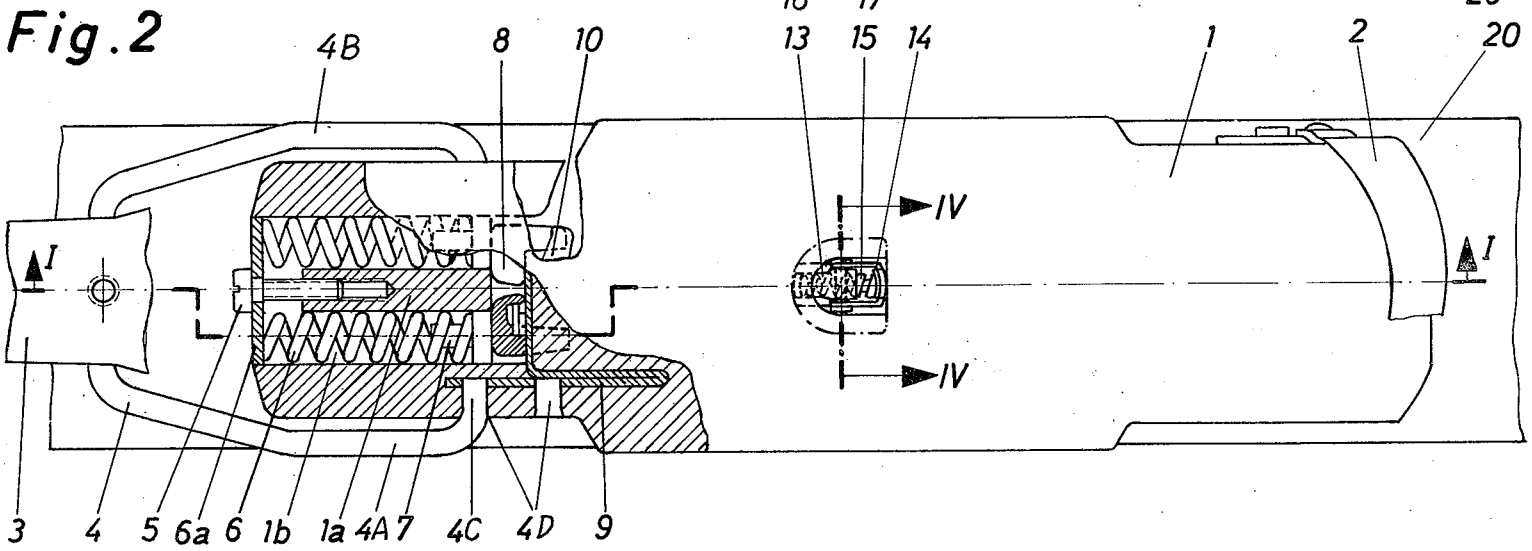
FIG. 2 is a top view of FIG. 1, partially in a cross section.
Figure 5:
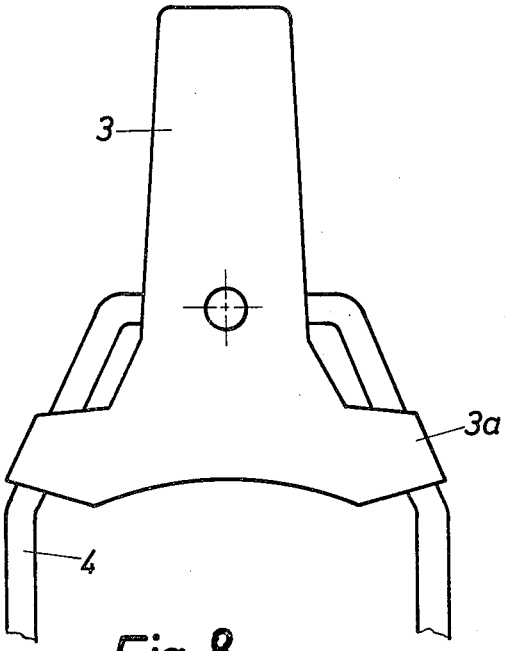
FIGS. 5 and 6 are associated views of a support for the tensioning means.
Figure 6:
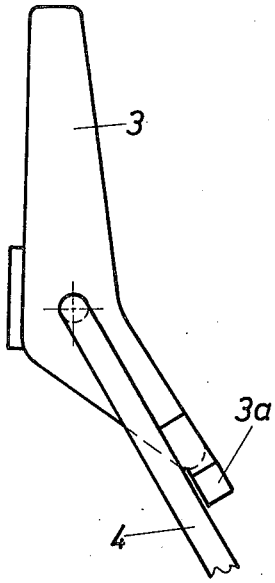
Figure 8:
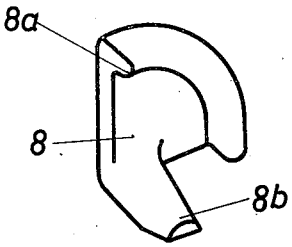
FIGS. 7 to 9 are details of the swivel members or their guide.
Figure 7:
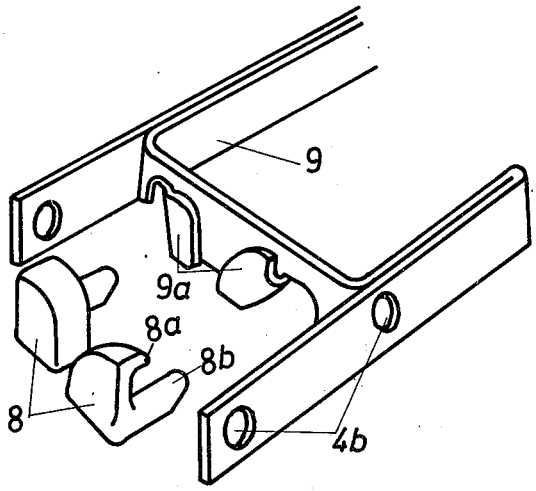

FIG. 1 illustrates a release plate 1 mounted on a partially illustrated ski 20, which plate 1 is releasably held on the ski 20 by means of a front holding means 12, a pivot pin 13 and a rear anchor member or metal fitting 10. A front sole holder 2 and a tensioning means 3 are arranged on the plate 1 and serve to secure the boot on the plate. The tensioning means 3 is longitudinally adjustable to facilitate the securement of various lengths of boots between the front sole holder 2 and the tensioning means 3. As is illustrated in FIG. 2, the tensioning means 3 is connected to the plate 1 through a fixed linkage or bar 4 having a pair of legs 4A and 4B. The free end of the legs 4A and 4AB are bent as at 4C and are inserted into one pair of multiple longitudinally spaced pairs of recesses 4D in the plate 1. In the present exemplary embodiment, there is provided a two-stage longitudinal adjustment for the tensioning means 3 in the recess 4D. The embodiment according to FIGS. 5 and 6 illustrates the tensioning means 3 having outwardly directed wings 3*a* which are supported on the linkage 4 after overcoming the dead-center position. This construction assures that the tensioning moment of the tensioning means after overcoming the dead-center position is not supported on the leg of the boot, but on the linkage.

Figure 3:
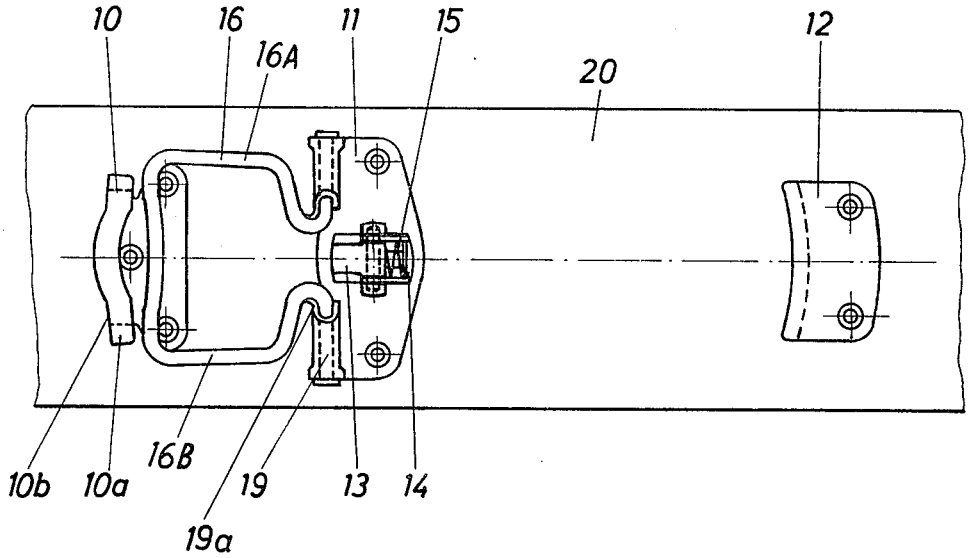
FIG. 3 illustrates details of the holding mechanisms for the plate with the plate omitted.
Figure 4:
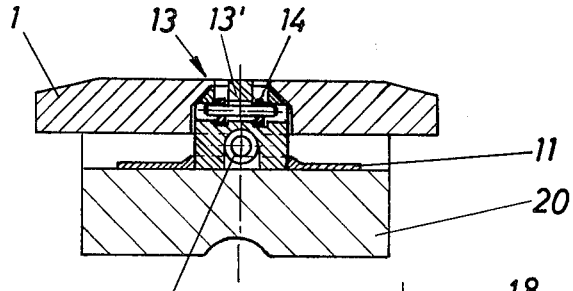
FIG. 4 is a cross-sectional view of FIG. 2 taken along the line IV—IV.
Figure 10:
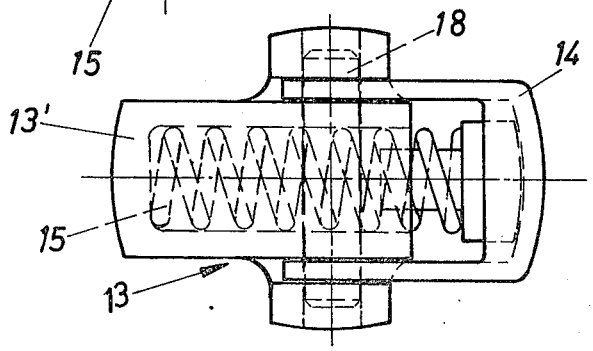
FIG. 10 is an enlarged detail of FIG. 3.
Figure 9:
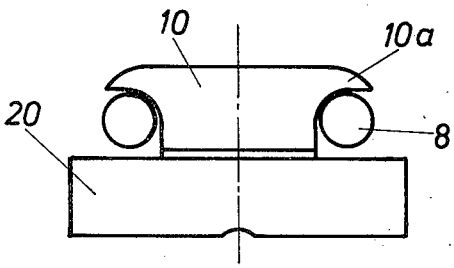

The rear holding mechanism for the plate 1 has a pair of locking or swivel members 8 and two piston members 7 which cooperate with the swivel members 8. The piston members are spring loaded by springs 6. The initial stress of the springs 6 can be adjusted by means of a setscrew 5 which is engaged with a receiving part 1*a* of the plate 1. The receiving part 1*a* is centrally disposed etween the springs 6 and the setscrew 5 cooperates with a common spring plate 6*a* engaging and supporting the common end of the springs 6. An adjustment of the setscrew 5 effects a compressing of the springs in the recesses 1*b* in the plate 1 between the spring plate 6*a* and the swivel members 8. The swivel members 8 have an approximate L-shape in horizontal and vertical longitudinal cross section. They both lie freely in the recesses which are framed by the remaining parts of the plate. A falling out or inadvertent removal of the swivel members 8 after release of the plate 1 from the ski is prevented by reinforcing insert 9 secured to the plate 1. The insert 9 has holding parts 9*a* which grip under protuberances 8*a* on the swivel members 8 and at the same time serve as a reinforcement of the plate 1 and as a support for the forces on the swivel member 8, in case same are made of plastic. Each of the swivel members 8 has a free end (extension 8*b*) which extends beneath a projecting ear 10*a* on the rear anchor member or metal fitting 10 secured to the ski. The swivel members 8 rest against the piston members 7 with the rear end part of the other leg part which extends between the protuberance 8*a* and the extension 8*b*. This design assures that in the case of a twisting fall, only one of the swivel members 8 is swung outwardly with the other swivel member being slid without any resistance out from beneath the ear 10*a* on the rear metal fitting 10. By comparing FIGS. 2 and 3, it will be easily recognized that in the case of a side release, only one swivel member 8 is swung and slid along the shoulder 10*b* of the rear metal fitting 10. Since the other swivel member 8 slides without any resistance out from engagement with the associated ear 10*a* (See FIG. 9), it follows that in the case of a release to the side only one of the springs 6 is loaded, namely only one spring must be overcome. During a fall forwardly, however, both swivel members 8 are swung against the force of the springs 6, since now the swivel members 8 are held down by the ears 10*a* on both sides of the rear metal fitting 10. Since now both springs must be simultaneously compressed, twice as much force is needed for a release upwardly than is required for a lateral release. During a diagonal fall, a combination of a forward-sideward force is generated so that in this case spring forces of 1 to 2 times will prevail. The limit values 1 and 2 for the spring force are excluded from this discussion because these can only occur during a pure sideward or frontward fall.

Figure 11:
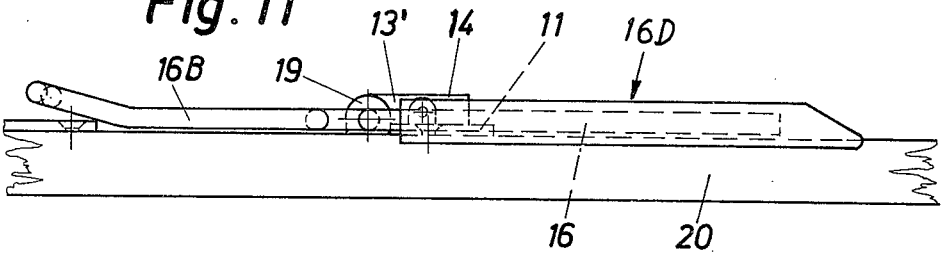
FIGS. 11 to 13 illustrate a modified construction including a ski brake.
Figure 12:
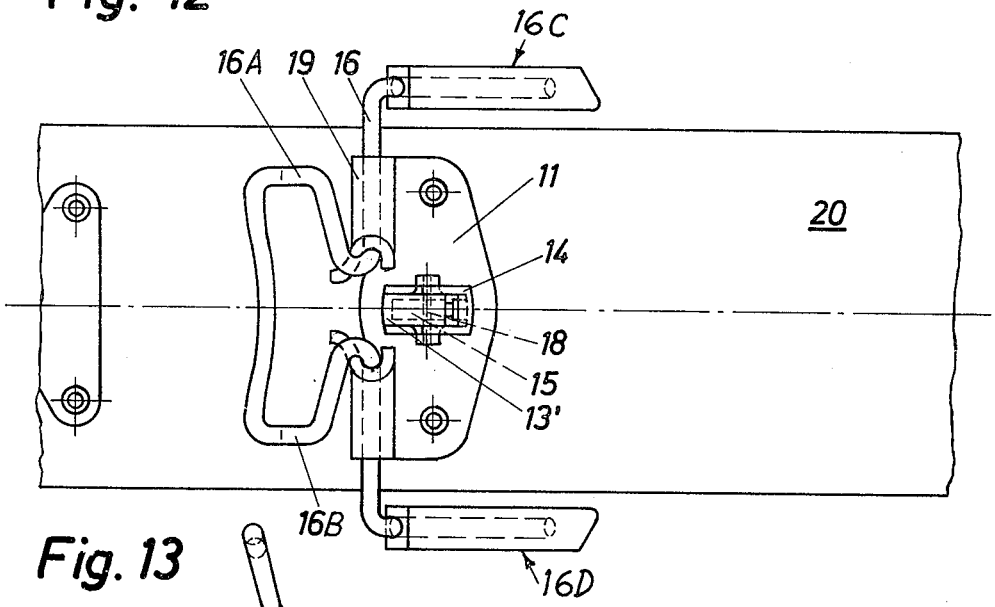
Figure 13:
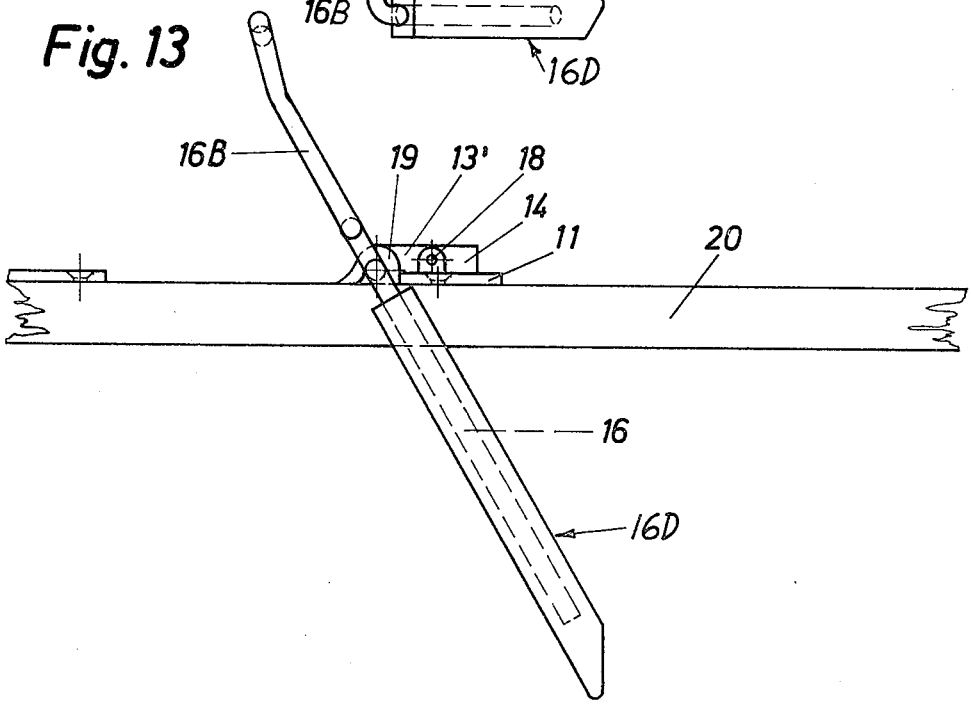

The release plate 1 has approximately in its center area a recess 1*c* which receives therein and cooperates with the pivot pin 13. The pivot pin 13 is held by and partly in a holding plate 11, which serves at the same time as a support for a step-in aid 16 (See FIG. 3). The step-in aid 16 consists substantially of an approximately U-shaped holding bar having legs 16A and 16B, the free ends of which are bent outwardly and are held in bearings 19 on the holding plate 11. Through its expanding-tension, the bar 16 has the tendency to swing into a vertical position due to the inclined surface 19*a* (FIG. 3) on the bearings 19. The step-in aid 16 has the purpose, in cooperation with a lower recess 1*d* in the plate 1, of guiding same correctly onto the pivot pin 13 or into the front holding means 12 and the rear metal fitting 10. If the legs 16A and 16B of the step-in aid 16 are extended outwardly as in FIG. 11 to 13 so that they project beyond the width of the ski and form additional bent wings or arms 16C and 16D, then the step-in aid can function simultaneously as an integrated ski brake. The pivot pin, which in its entirety is identified by reference numeral 13, has a housing 13' and a slide 14. The slide 14 can be moved relative to the housing 13' against the force of a spring 15 in longitudinal direction of the plate 1. The housing 13' has for this purpose a crossbolt 18 cooperating with and received in a slotted hole 17 in the slide 14. The slide 14 is designed circularly in top view and also the housing 13' of the pivot pin 13 is rounded off outwardly with the radius of this circle. The recess 1*c* in the plate 1 is also rounded off in the rear half thereof so that the plate 1 can carry out unhindered the necessary swivel movements about the pivot pin 13. The spring 15 is thereby dimensioned such that it assures the secure hold for the plate 1. The spring 15 is designed so strong that, on the one hand, the thrust forces to the rear (during skiing) are absorbed and, on the other hand, a longitudinal shifting of the plate can still take place during re-engagement. The clamping itself is accomplished by the springs 6. Following a release and when it is desired reconnect to the ski, the sole plate which is clamped on the boot is moved so that the tip or front thereof is positioned in front of the front holding means 12 on the ski and so that at the same time the vertically erected bar 16 is received in the plate recess 1*d*. The plate 1 is now stepped down like in known automatically operated heel clamps and is thereby guided over the pivot pin 13 by the guide bar 16. The pivot pin 13 now takes over in centering the plate 1 on the ski due to the snug receipt in the recess 1*c*. During the further course of stepping down, the pins of the swivel members 8 come to rest on the upper part of the shoulder 10*b* of the metal fitting 10 and are guided along said shoulder. The plate is thus shifted longitudinally against the force of the spring 15 until it rests on the ski. In this position, the plate 1 again moves forwardly due to the spring 15 (and slide 14) and the swivel members 8 engage the metal fitting 10 and the front holder 12 is received in the corresponding plate recess. The downhill position is thus achieved.

The invention is not limited to the illustrated exemplary embodiment. Further modifications are conceivable, without departing from the scope of the invention. For example, it is possible to provide a fixed pivot pin which cooperates with a slotted hole in the plate. Also holding down of the boot on the plate is not limited to the shown front sole holder and tensioning means, for example similarly designed holding bars can be used which are screwed or bayonetlike secured in bores which are arranged in longitudinal direction of the plate. These constructions are actually known, the indicated variations are only intended to show the many possibilities of use of the subject matter of the application.

Compared with known constructions, the inventive release binding has in particular the following advantages:

Release value which are independent from contamination through the use of the covered swivel members.

Compact method of construction.

Thrust independency due to fixed center pivot point.

Simple buckling on of skis due to fixed tensioning linkage, which cannot adjust automatically.

Possibility for an integrated ski brake.

Shifting of the pivot point to the back. In the case of a forward release the pivot point is supposed to lie as far back as possible.

As is known important lever-technical advantages are thereby obtained for the system lower leg/binding.

Although particular preferred embodiments of the invention have been disclosed in detail for illustrative purposes, it will be recognized that vairations of modifications of the disclosed apparatus, including the rearrangement of parts, lie within the scope of the present invention.

The embodiments of the invention in which an exclusive property or privilege is claimed are defined as follows:

1. A release ski binding, comprising:

an elongate release plate having means defining a first recess in the bottom surface intermediate the ends thereof;

releasable holding means for releasably securing said release plate to a ski, said releasable holding means including an upstanding pin means, adapted to be secured to said ski and received in said first recess to pivotally support said release plate for movement about the axis of said upstanding pin means, said upstanding pin means having an initial size greater than said first recess and including means for yieldingly reducing the diameter of said pin means to facilitate a snug reception in said first recess;

a first holding means adapted to be secured to said ski and operatively connecting said ski to said release plate adjacent one end thereof;

a second holding means adapted to be secured to said ski and operatively connecting said ski to said release plate at the other end thereof, said second holding means including an anchor member secured to said ski and variable force resilient means for continually urging said release plate to a position of use wherein the longitudinal axis thereof is parallel to the longitudinal axis of said ski when said release plate is held to said ski by said first and second holding means and providing a lesser magnitude of force to effect a release of said release plate in response to a movement thereof solely about said axis of said upstanding pin means than the force required to effect a release in response to a movement of said other end in any direction other than about said axis of said pin means, said release plate also having a second recess intermediate said first recess and said other end;

guide means mounted on said ski intermediate said pin means and said second holding meas, said guide means including a holding plate secured to said ski and a bar member pivotally secured to said holding plate about an axis extending transversely of the longitudinal axis of said ski and between a first position inclined relative to the upper surface of said ski and a second position generally parallel to said upper surface of said ski, said bar member being received in said second recess to guide said release plate into securement with said releasable holding means as said bar member is moved from said first position to said second position;

a first sole holder means mounted on said release plate adjacent one end thereof;

a second sole holder means mounted on said release plate adjacent said other end thereof, said second sole holder means including a pair of wire bars each having a leg with an inwardly turned end portion, the other ends of said legs being bent to define a pair of axially aligned axles, said release plate having means defining laterally opening recesses therein for receiving said axles therein to effect a pivotal securement of said bars to said release plate; and a tensioning member pivotally secured to said end portions, said tensioning member having a pair of outwardly directed wings which engage said legs to thereby prevent an engagement of said tensioning member with a shell of a ski boot when said ski boot is releasably held between said first and second sole holders.

2. A release ski binding according to claim 1, wherein said variable force resilient means is housed in and between the upper and lower surfaces of said release plate and having at least one locking member and support means for supporting said locking member for swivel movement against the urging of said variable force resilient means, said locking member operatively engaging said anchor member, the force required to swivel said locking member about a vertical axis parallel to said axis of said pin means being less than a swivel movement of said locking member about any other axis.

3. A release ski binding according to claim 1, wherein said upstanding pin means includes housing means, a holding plate connected to said housing means and adapted to be secured to said ski, said housing means having means defining a third recess therein, a spring housed in said third recess with one end thereof engaging said housing means, the longitudinal axes of said third recess and said spring being coextensive and parallel to the longitudinal axis of said ski, a slide member partially surrounding said housing means and being operatively connected to the other end of said spring and second support means supporting said slide member for both a reciprocating movement along said longitudinal axis of said ski against the urging of said spring and a rotary movement about said axis of said pin means, said slide member engaging only a first portion of the internal surface of said first recess, the diametrically opposite side of said housing means engaging only a second portion of said internal surface of said first recess so that said pin means is snugly received in said first recess.

4. A release ski binding according to claim 1, wherein said guide means further includes mounting means for continually urging said bar member from said second position toward said first position;

wherein said bar member includes a generally U-shaped wire bar having a pair of legs and a bight portion, the free ends of said legs being bent to define axially aligned axles;

wherein said mounting means is provided on said holding plate and is defined by a pair of bearing members which receives said axles therein, said bearing members having cam surfaces thereon operatively engaging said legs to urge said legs inwardly toward each other against the spring resistance of said wire bar as said wire bar is moved from said first position toward said second position, said spring resistance effecting a continual urging of said wire bar toward said first position; and wherein said wire bar has brake arms extending from said axles laterally spaced outwardly from the lateral edges of said ski and generally parallel to said lateral edges when said wire bar is in said second position, said brake arms extending downwardly beyond the bottom surface of said ski when said wire bar is in said first position.

5. A release ski binding, comprising:

an elongate release plate having means defining a first recess in the bottom surface intermediate the ends thereof;

releasable holding means for releasably securing said release plate to a ski, said releasable holding means including an upstanding pin means adapted to be secured to said ski and secured to said ski and received in said first recess to pivotally support said release plate for movement about the axis of said upstanding pin means, a first holding means operatively connecting said ski to said release plate adjacent one end thereof and a second holding means operatively connecting said ski to said release plate at the other end thereof, said second holding means including an anchor member secured to said ski and variable force resilient means for continually urging said release plate to a position of use wherein the longitudinal axis thereof is parallel to the longitudinal axis of said ski when said release plate is held to said ski by said first and second holding means and providing a lesser magnitude of force to effect a release of said release plate in response to a movement thereof solely about said axis of said upstanding pin means than the force required to effect a release in response to a movement of said other end solely upwardly away from the upper surface of said ski, said variable force resilient means being housed in and between the upper and lower surfaces of said release plate and having at least one locking member and support means for supporting said locking member for swivel movement against the urging of said variable force resilient means, said locking member operatively engaging said anchor member, the force required to swivel said locking member about a vertical axis parallel to said axis of said pin means being less than a swivel movement of said locking member about any other axis.

6. The release ski binding according to claim 5, wherein said variable force resilient means includes a pair of parallel and laterally spaced springs each housed in said release plate between said upper and lower surfaces thereof, the extended axes of said springs extending on opposite lateral sides of said axis of said pin means and further includes a pair of piston members each engaging one end of a respective spring and being reciprocally movable along the axes of said springs, the other ends of each of said springs engaging abutment means on said release plate;

wherein a pair of said locking members is provided each operatively connected to a respective one of said piston members, a swivelling of both of said locking members effecting a reciprocating movement of said piston members against the urging of said springs; and wherein said anchor member is positioned between said locking members and includes a pair of profiled surfaces operatively engaged by said locking members, said profiled surfaces each including an end zone for releasing the operative engagement with said locking members in directions perpendicular to the longitudinal axis of said ski and without effecting a reciprocating of the respective piston member against the spring force of the associate spring.

7. The release ski binding according to claim 6, wherein said abutment means includes an adjusting mechanism for varying the position thereof relative to said release plate to effect a change in the initial tension of said springs.

8. The release ski binding according to claim 5, wherein the bottom surface of said release plate includes means defining a second recess adjacent said other end thereof;

wherein said locking member has two perpendicularly related legs, one leg engaging said piston member, the other leg of said locking member extending parallel to the longitudinal axis of said ski and into said second recess, said anchor member being received in said second recess for operative connection to said other legs.

9. The release ski binding according to claim 8, wherein said one leg of said locking member is operatively connected to said support means.

10. The release ski binding according to claim 8, wherein said one leg of said locking member is operatively connected to said support means;

wherein said support means includes a reinforcing insert secured to said release plate and has a portion extending into said second recess; and wherein said one leg of said locking member has a protuberance thereon gripping over the top of said portion extending into said second recess.

11. The release ski binding according to claim 8, wherein said one leg has a flat surface thereon engaging said piston member.

12. The release ski binding according to claim 5, wherein said releasable holding means provides the sole structure by which said release plate can be released from said ski.

13. A release ski binding, comprising:

an elongate release plate having means defining a first recess in the bottom surface intermediate the ends thereof;

releasable holding means for releasably securing said release plate to a ski, said releasable holding means including an upstanding pin means adapted to be secured to said ski and received in said first recess to pivotally support said release plate for movement about the axis of said upstanding pin means, said upstanding pin means including housing means, a holding plate connected to said housing means and adapted to be secured to said ski, said housing means having means defining a second recess therein, a spring housed in said second recess with one end thereof engaging said housing means, the longitudinal axes of said second recess and said spring being coextensive and parallel to the longitudinal axis of said ski, a slide member partially surrounding said housing means and being operatively connected to the other end of said spring and support means supporting said slide member for both a reciprocating movement along said longitudinal axis of said ski against the urging of said spring and a rotary movement about said axis of said pin means, said slide member engaging only a first portion of the internal surface of said first recess, the diametrically opposite side of said housing means engaging only a second portion of said internal surface of said first recess so that said pin means is snugly received in said first recess.

14. The release ski binding according to claim 13, wherein said first and second portions of said internal surface of said first recess are rounded; and wherein said slide member and said diametrically opposite side of said housing means are rounded to correspond to the rounding of said first and second portions.

15. The release ski binding according to claim 13, wherein said support means includes a crossbolt mounted on said housing means and extending transversely of the longitudinal axis of said ski and outwardly of said housing means, the part of said slide member which partially surrounds said housing means having at least one elongated hole therein receiving said crossbolt therethrough to define a guide for said slide member.

16. The release ski binding according to claim 15, wherein said crossbolt extends outwardly from a opposite sides of said housing means; and wherein said slide member has a pair of side members which define said part which partially surrounds said housing means, each of said side members having said elongated hole therein receiving said crossbolt therethrough.

17. The release ski binding according to claim 13, wherein the axes of said second recess and said pin means intersect.

18. A release ski binding, comprising:

an elongate release plate having means defining a first recess in the bottom surface intermediate the ends thereof;

releasable holding means for releasably securing said release plate to a ski, said releasable holding means including an upstanding pin means adapted to be secured to said ski and received in said first recess to pivotally support said release plate for movement about the axis of said upstanding pin means, a first holding means adapted to be secured to said ski and operatively connecting said ski to said release plate adjacent one end thereof and a second holding means adapted to be secured to said ski and operatively connecting said ski to said release plate at the other end thereof, said release plate also having a second recess intermediate said first recess and said other end; and guide means mounted on said ski intermediate said pin means and said second holding means, said guide means including a holding plate secured to said ski and a bar member pivotally secured to said holding plate about an axis extending transversely of the longitudinal axis of said ski and between a first position inclined relative to the upper surface of said ski and a second position generally parallel to said upper surface of said ski, said bar member being received in said second recess to guide said release plate into securement with said releasable holding means as said bar member is moved from said first position to said second position.

19. A release ski bonding according to claim 18, wherein said guide means further includes mounting means for continually urging said bar member from said second position toward said first position.

20. A release ski binding according to claim 19, wherein said bar member includes a generally U-shaped wire bar having a pair of legs and a bight portion, the free ends of said legs being bent to define axially aligned axles; and wherein said mounting means is provided on said holding plate and is defined by a pair of bearing members which receives said axles therein, said bearing members having cam surfaces thereon operatively engaging said legs to urge said legs inwardly toward each other against the spring resistance of said wire bar as said wire bar is moved from said first position toward said second position, said spring resistance effecting a continual urging of said wire bar toward said first position.

21. A release ski binding according to claim 20, wherein said wire bar has brake arms extending from said axles laterally spaced outwardly from the lateral edges of said ski and generally parallel to said lateral edges when said wire bar is in said second position, said brake arms extending downwardly beyond the bottom surface of said ski when said wire bar is in said first position.

22. A release ski binding, comprising:

an elongate release plate;

releasable holding means for releasably securing said release plate to a ski;

a first sole holder means mounted on said release plate adjacent one end thereof; and a second sole holder means mounted on said release plate adjacent to the other end thereof, said second sole holder means including a pair of wire bars each having a leg with an inwardly turned end portion, the other ends of said legs being bent to define a pair of axially aligned axles, said release plate having means defining laterally opening recesses therein for receiving said release axles therein to effect a pivotal securement of said bars to said release plate, a tensioning member pivotally secured to said end portions, said tensioning member having a pair of outwardly directed wings which engage said legs to thereby prevent an engagement of said tensioning member with a shell of a ski boot when said ski boot is releasably held between said first and second sole holders.

23. A release ski binding according to claim 22, wherein said release plate has a reinforcing insert embedded therein adjacent said laterally opening recesses, said reinforcing insert having holes therein axially aligned with said laterally opening recesses and receiving said axles therein.

24. A release ski binding according to claim 23, wherein said reinforcing insert has an approximate H-shape with two pairs of generally parallel legs; and wherein said holes are provided in said legs.

* * * * *

UNITED STATES PATENT AND TRADEMARK OFFICE

CERTIFICATE OF CORRECTION

PATENT NO. : 4 130 297

DATED : December 19, 1978

INVENTOR(S) : Hans Horn

It is certified that error appears in the above-identified patent and that said Letters Patent are hereby corrected as shown below:

Column 6, line 45; change "meas" to ---means---.

Column 8, line 4; delete "secured to said ski and" (first occurrence).

Column 8, line 7; after "means" (second occurrence) insert ---adapted to be secured to said ski and---.

Column 8, line 9; after "means" insert ---adapted to be secured to said ski and---.

Column 10, line 10; delete "a".

Column 10, line 52; change "bonding" to ---binding---.

Column 11, line 18; delete "to".

Column 12, line 2; delete "release".

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*